US012569712B2

(12) United States Patent
Tobin

(10) Patent No.: US 12,569,712 B2
(45) Date of Patent: Mar. 10, 2026

(54) WEIGHT WITH INCREMENTAL INSERTS

(71) Applicant: Arnold Tobin, Springfield Gardens, NY (US)

(72) Inventor: Arnold Tobin, Springfield Gardens, NY (US)

( * ) Notice: Subject to any disclaimer, the term of this patent is extended or adjusted under 35 U.S.C. 154(b) by 43 days.

(21) Appl. No.: 18/622,862

(22) Filed: Mar. 29, 2024

(65) Prior Publication Data

US 2024/0342540 A1 Oct. 17, 2024

Related U.S. Application Data

(60) Provisional application No. 63/534,372, filed on Aug. 24, 2023, provisional application No. 63/455,906, filed on Mar. 30, 2023.

(51) Int. Cl.
*A63B 21/072* (2006.01)
*A63B 21/075* (2006.01)

(52) U.S. Cl.
CPC ..... *A63B 21/0726* (2013.01); *A63B 21/075* (2013.01); *A63B 2209/08* (2013.01); *A63B 2220/52* (2013.01); *A63B 2230/06* (2013.01)

(58) Field of Classification Search
CPC ..... A63B 21/0726; A63B 21/075; A63B 21/4035; A63B 2209/08; A63B 2220/40; A63B 2220/52; A63B 2225/20; A63B 2225/54; A63B 2230/06
See application file for complete search history.

(56) References Cited

U.S. PATENT DOCUMENTS 4,867,444 A * 9/1989 Castillo ..... A63B 21/4035 482/106
5,735,777 A * 4/1998 Benoit ..... A63B 21/0728 482/106
7,381,167 B2 * 6/2008 Duhamel ..... A63B 21/0726 482/139
7,458,921 B2 * 12/2008 Hallar ..... A63B 21/0726 482/106
7,588,519 B2 * 9/2009 McClusky ..... A63B 21/06 482/106
7,780,582 B2 * 8/2010 Anderson ..... A63B 21/075 482/106

(Continued)

FOREIGN PATENT DOCUMENTS

CN 201871172 U 6/2011
GB 2413288 A 10/2005

*Primary Examiner* — Joshua Lee
(74) *Attorney, Agent, or Firm* — Olivo IP Law Group, P.C.; John W. Olivo

(57) ABSTRACT

The present invention is an exercise weight with incremental weight inserts. The ends of the weight will be hollow to fit the different weighted inserts inside. The weighted inserts are screwed in and stay in place with magnets. The handle of the weight will be oval shaped and tapered down to fit the natural grip of the hand. The weighted inserts will be a different weight on each side of the dumbbell to maintain the same overall weight percentage, starting with either a ¼th pound or .25 kg insert. The weights will come in different sizes for men and for women due to the differences in sizes of men's and women's hands. With the incremental weight inserts and the angled and narrowing handle, the user will be able to have a safe and effective workout.

4 Claims, 8 Drawing Sheets

(56) References Cited

U.S. PATENT DOCUMENTS

| | | | | |
|---|---|---|---|---|
| 7,785,239 | B2 * | 8/2010 | Daniel | A63B 21/0728 482/93 |
| 7,789,813 | B2 * | 9/2010 | Anderson | A63B 21/0728 482/106 |
| 8,123,662 | B2 * | 2/2012 | Anderson | A63B 21/0728 482/106 |
| 8,210,996 | B2 * | 7/2012 | Anderson | A63B 21/063 482/107 |
| 8,241,189 | B2 * | 8/2012 | Kanaoka | A63B 21/0726 482/50 |
| 8,894,553 | B2 * | 11/2014 | Anderson | A63B 21/063 482/106 |
| 2006/0003876 | A1 | 1/2006 | Duhamel | |
| 2007/0298940 | A1 | 12/2007 | Anderson | |
| 2009/0048079 | A1 | 2/2009 | Nalley | |
| 2017/0001061 | A1 | 1/2017 | Marjama et al. | |
| 2022/0016464 | A1 | 1/2022 | Parra Marmolejo | |
| 2022/0409945 | A1 | 12/2022 | Bhandarkar et al. | |

* cited by examiner

WEIGHT WITH INCREMENTAL INSERTS

PRIORITY CLAIMS

This application claims the benefit of U.S. Provisional Application Ser. No. 63/455,906 filed Mar. 30, 2023. This application also claims the benefit of U.S. Provisional Application Ser. No. 63/534,372 filed on Aug. 24, 2023 the contents of which are incorporated herein by reference.

BACKGROUND OF THE INVENTION

The present invention pertains to an exercise weight with incremental weight inserts.

Exercise weights are immensely popular pieces of equipment within the realm of exercising. Oftentimes, exercise weights come in singular sizes. Typically, a person must use a separate weight to accommodate for their desired change in weight. As a result, multiple weights that are used for a single weight-training session ultimately create excessive bulk and lead to constant trips back and forth to place the weights where they were initially taken from. While some people may utilize weights with inserts, often the design of these pieces of equipment interferes with form, as sometimes the weights protrude, and the handles of these weights cause more strain, fatigue, and weight protrusions that get in the way of a successful workout.

The present invention remedies these problems by creating a weight with incremental weight inserts and an angled handle for safety. As form is crucial for weight training, the present invention encourages proper form by way of a weight that has a comfortable handle and enables a gradual increase of weight. Because muscles need to be continually stressed by working against a weight or resistance more fantastic than they are used to, a weight with incremental inserts is ideal for an individual who seeks to increase muscle growth. The incremental weight comes in a variety of iterations and may be magnetically attached or screwed on to a base.

SUMMARY OF THE INVENTION

The present invention pertains to an exercise weight with incremental weight inserts. The incremental weight inserts are either magnetically attached or screwed into a single base. Each dumbbell or base will have hollow ends, or a cavernous opening for the magnetically connected or screwed incremental weight to be attached. A user can adjust the dumbbell or base to their desired weight by inserting the magnetic weights or, in some embodiments, securely stacking the magnetic weights. Once the magnetic weights are magnetically connected or screwed into the opposite ends of said dumbbell or base, then a user may begin their workout and reps. A user may change the weights with each rep or simply repeat the weight of their previous set. Incremental weights, which are usually attached to either a dumbbell or metal base, allow for a gradual increase in resistance which ultimately assists with improvement in strength and endurance. Incremental weights help neuromuscular systems develop new muscle fibers as it encourages the muscle to adapt to each progressive change in weight. The dumbbell end that houses a weight may also support an insert to support heavier weights or stacking weights within a cavernous opening to minimize protrusion. With the weight inserts, a user can reduce strain in their hands and increase weight while also protecting their grip.

In addition to a unique, internally stackable weight, the exercise weight also has an angled and narrowing handle. This is handling structure is best suited for the natural anatomical position of a person's hands and considers how a user's fingers lay in a closed grip. As such, the strain on the wrists and hands are minimized while the weight is being lifted, allowing a user to focus on specific areas they would like to build muscle as opposed to the discomfort of their hands and wrists. This insert, in combination with the angled and narrowing handle, reduces the likelihood of an injury and vastly improves performance.

The weights, without the weighted inserts, come in various predetermined weighted sizes. This enables different people to start at different weight levels. This way, the weighted inserts can increase at the same weight percentage for everyone, regardless of what the starting weight is. The incremental insert discloses its weight in pounds and kilos, starting with ¼ pound and .25 kg. One person can start with a 20-pound weight and use an insert that graduates every fourth pound, while another person may start with an instrument that is 25 pounds and go up every fourth pound. The process is wholly customizable, and the user can fine tune the apparatus to their desired weight.

A user starts with a weight with their chosen predetermined weight size. The angled handle enables an appropriate grip on the handle of the weight, which minimizes fatigue. If the user wishes to graduate to a higher weight, the user may screw one of the magnetic weighted inserts into the end of the weight. In some embodiments, the magnetic weight may also be screwed in addition to magnetically attached to the dumbbell, or exclusively magnetized. A user can unscrew the weighted insert and screw in another magnetic weighted insert to increase the weight of the dumbbell. Throughout the user's exercise, the user can continuously improve in multiple weight increments for a more challenging workout.

The weights may also be structured differently according to various body compositions, and genders. In the art, there is currently a lack of weights and dumbbells that cater towards women and people with smaller grips. For example, dumbbells may be of a wider width and do not accommodate to smaller hands, and are lengthier, completely neglecting how form would be impacted by said differences in body compositions. As a result, added strain is applied to women's hands and those with smaller grips when using a weight. For individuals with smaller grips, the design is ideal. The angled handle is shorter, dinner and more appropriately suited for a diverse range of grips, indiscriminately. As mentioned, the magnetic weighted inserts are still screwable, and can be increased based on a user's desire.

With regards to the shape of the weighted inserts, they typically will come in an oval shape to maintain the natural taper down effect of a hand's grip without the protrusion of the end of the weights. The incremental weighted inserts will increase with the exact weight percentages. In some embodiments, the dumbbell may transmit exercise data, such as heart rate, lifting, and measurement data, as well as grip data. The data is acquired by way of sensors, such as accelerometers and load sensors that are stationed on the exercise weight and transmit data to a receiving device or to a non-transitory computer. The receiving device comprises of smart device memory. An RFID chip can be used to track the location of an incremental weight. Through a companion app, platform, and software-a user can view their health and exercise data on various smart devices, such as a smart watch, or cellular device. This feature allows a user to track weight and rep data, and even receive a notification if a weight is insecurely screwed, needs an adjustment, or a user is experiencing more fatigue than usual. For example, if a user is significantly struggling during a workout, a notification may pop up reminding a user of the number of weighted inserts, and whether they should size down.

In addition to the unique shape and screw design, the weighted inserts will employ a color-coded system to differentiate the different weights. Each incremental weight insert will also come in a different color to signify the additional weight of each insert. The insert will weigh the same on each side of the dumbbell to maintain balance. By way of example and not limitation, men's weights could come in the color blue, while the women's weights come in the color pink. The first ¼th pound incremental weight inserts will come in the color red. The second ¼th pound incremental weight inserts will come in the color yellow. The third ¼th pound incremental weight inserts will come in the color green, and so on and so forth. The weights will be made from iron but will be encased in a plastic casing of different colorways.

The incremental weight inserts also have the added benefit of saving space in a user's gym. With traditional weights, which do not feature insets, users must use a new weight which comes as a singular unit. That is, a user must have several weighted units to graduate the weights in their workout into a more rigorous routine. As a result, more space is taken up in a user's gym bag or personal gym. With the incremental weight inserts, a user only needs one dumbbell and the incremental weight inserts to increase the weight of their unit. This saves space in the gym and enables a user to graduate the size and weight of their exercise unit in a quick, streamlined process involving minimal back and forth.

The incremental weight inserts are also used for kettlebells, plated weights, and any gym equipment requiring holding and gripping. The same oval and tapered shape is applied to all other pieces of weighted gym equipment. This ensures that no matter what exercise is being done, the equipment will always fit in the natural grip of the hand, eliminating wrist strain.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The various embodiments are illustrated by way of example, and not by way of limitation, in the figures of the accompanying drawings. Having thus described the invention in general terms, reference will now be made to the accompanying drawings, which are not necessarily drawn to scale, and wherein:

FIG. 1A is a top perspective view of the present invention and incremental weighted insert 102A. The insert 102A is screwed into the hollow end 100A of the weight with magnets to secure the insert in place. FIG. 1B is a side plan view of the present invention 100B showing the weighted insert 104B as well as the angled handle 102B. FIG. 1C is a bottom perspective view of the present invention 100C and incremental weighted insert 102B, 104C, which are color coded to depict different weights.

FIG. 2A is a side view of the present invention 200A and the incremental weighted insert 204A. The cavernous opposing sides 202A of the weight house the weighted inserts 204A. FIG. 2B is a line drawing of the side view of the present invention 200B, showing the angled ergonomic weight handle 208B to support a user's wrist when lifting, and the additional incremental weighted insert 204B. The cavernous opposing sides 202B of the weight are once more shown, which house the weighted inserts 204B. FIG. 2C is a line drawing of the side view of the present invention 202C showing the angled ergonomic weight handle 200C to support a user's wrist when lifting. The weighted inserts 204C are once more shown.

DETAILED DESCRIPTION OF THE PREFERRED EMBODIMENT

Figure 1A:
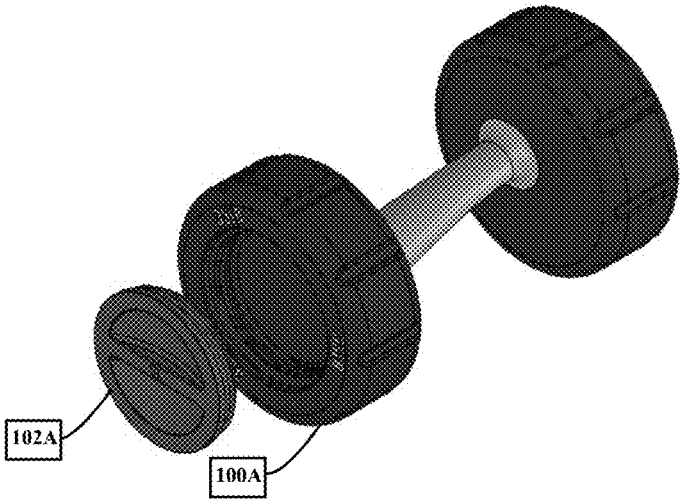
FIGS. 1A-C are drawings of perspective views of the present invention.
Figure 1B:
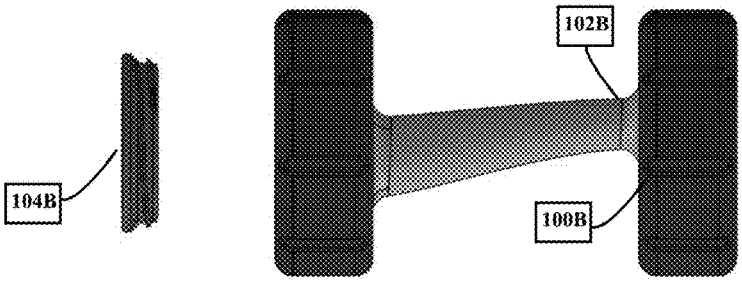
Figure 1C:
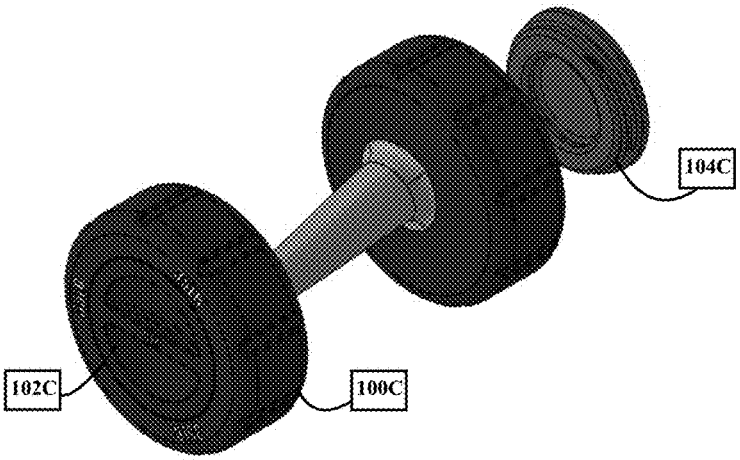

FIGS. 1A-C are drawings of perspective views of the present invention. FIG. 1A is a top perspective view of the present invention and incremental weighted insert 102A. The insert 102A is screwed into the hollow end 100A of the weight with magnets to secure the insert in place. FIG. 1B is a side plan view of the present invention 100B showing the weighted insert 104B as well as the angled handle 102B. FIG. 1C is a bottom perspective view of the present invention 100C and incremental weighted insert 102B, 104C, which are color coded to depict different weights.

Figure 2A:
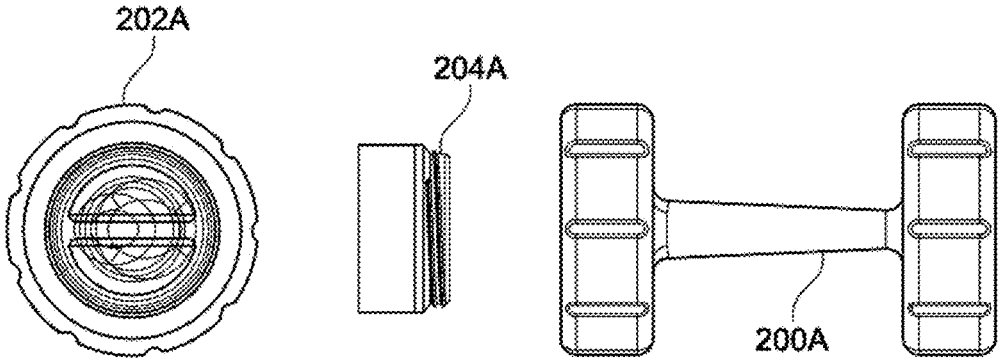
FIGS. 2A-C are line drawings of the present invention.
Figure 2B:
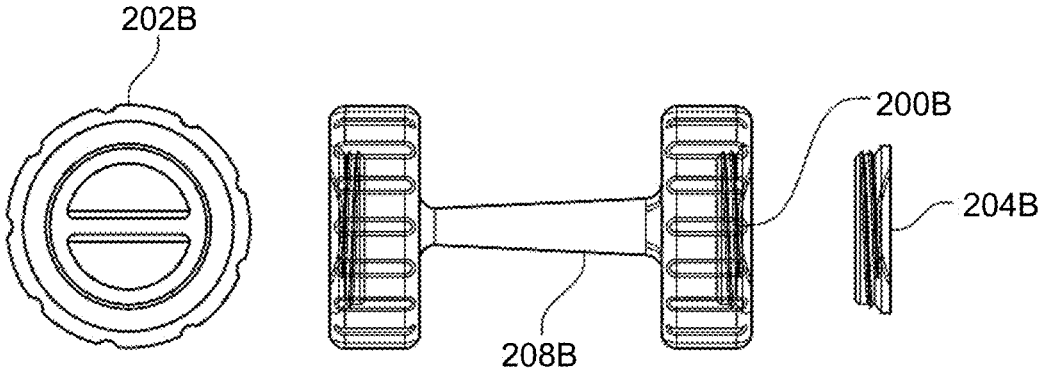
Figure 2C:
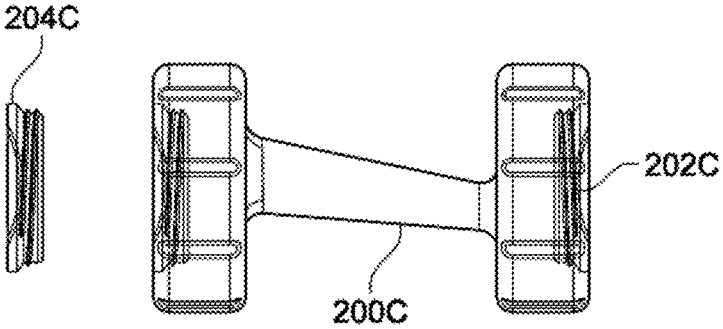

FIGS. 2A-C are line drawings of the present invention. FIG. 2A is a side view of the present invention 200A and the incremental weighted insert 204A. The cavernous opposing sides 202A of the weight house the weighted inserts 204A. FIG. 2B is a line drawing of the side view of the present invention 200B, showing the angled ergonomic weight handle 208B to support a user's wrist when lifting, and the additional incremental weighted insert 204B. The cavernous opposing sides 202B of the weight are once more shown, which house the weighted inserts 204B. FIG. 2C is a line drawing of the side view of the present invention 202C showing the angled ergonomic weight handle 200C to support a user's wrist when lifting. The weighted inserts 204C are once more shown.

Figure 3:
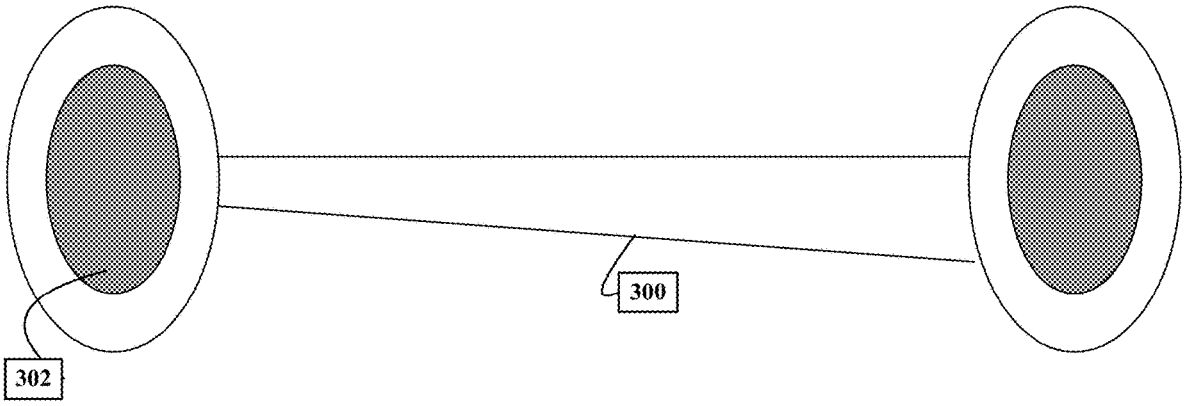
FIG. 3 is an example of the weight 300 with a weighted insert 302 inside. The weight 300 has an angled handle that fits into the natural grip of the hand. Each side of the weight has a weighted insert 302 screwed in. The weighted inserts have different colors to signify the different weight.

FIG. 3 is an example of the weight 300 with a weighted insert 302 inside. The weight 300 has an angled handle that fits into the natural grip of the hand. Each side of the weight has a weighted insert 302 screwed in. The weighted inserts have different colors to signify the different weight.

Figure 4:
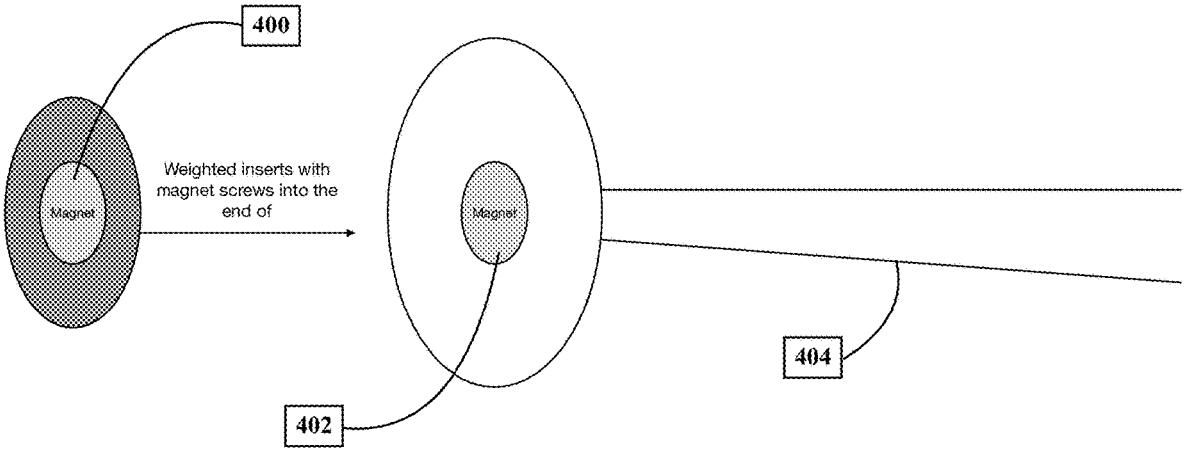
FIG. 4 is a diagram showing how the weighted insert is put into the end of the weight.

FIG. 4 is a diagram showing how the weighted insert is put into the end of the weight. Both the insert 400 and the inside of the end of the dumbbell have magnets on it 402. The insert is screwed into the hollow end of the weight and the magnets keep the insert securely in place. A threaded rod housed within the angled bar 404 may be used to stabilize the screwed insert and further fortify the use of magnets.

Figure 5:
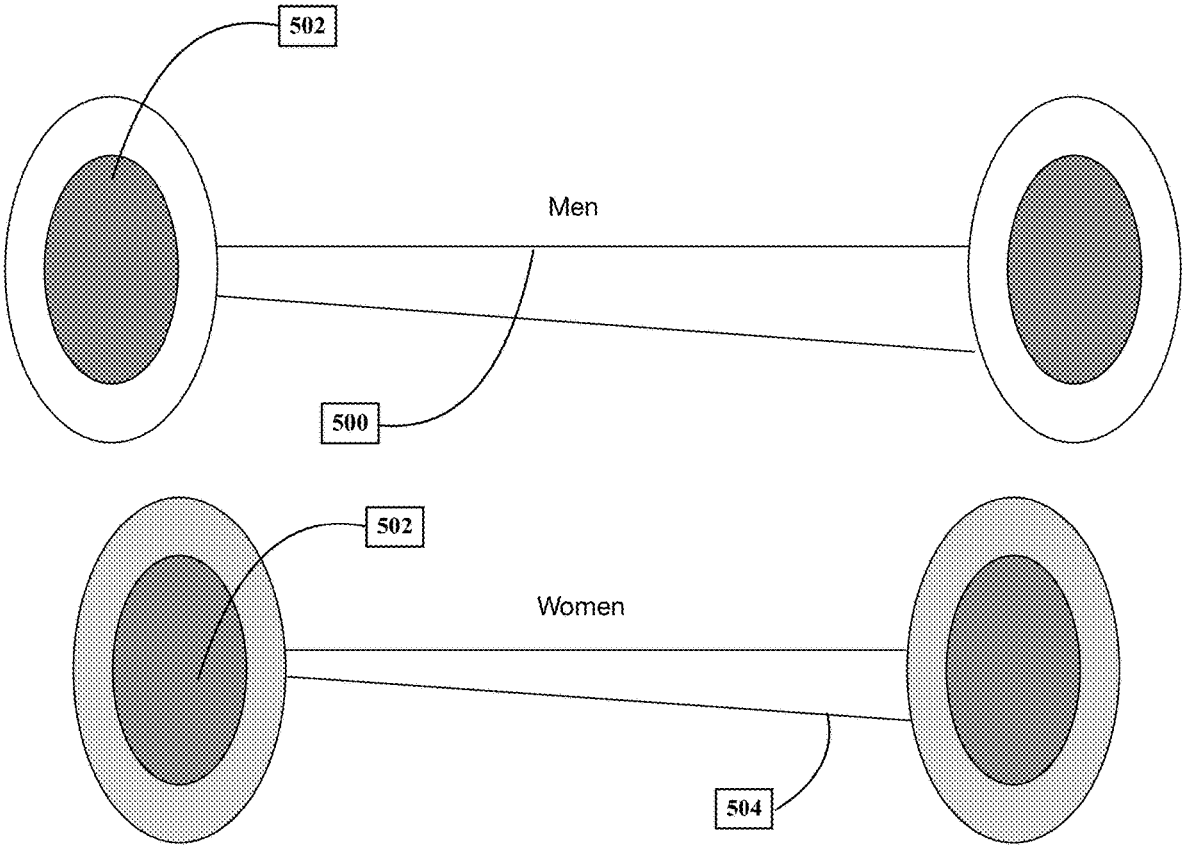
FIG. 5 is an example of the different designs for the exercise instrument, with respect to the anatomical structures of men's and women's hands. For the women, the handle 504 is slightly shorter and thinner whereas for men, the handle 500 is thicker. This helps the handle efficiently be held by individuals with smaller hands. This protects the grip for an individual's hand while maintaining the same overall design from larger weights 502.

FIG. 5 is an example of the different designs for the exercise instrument, with respect to the anatomical structures of men's and women's hands. For the women, the handle 504 is slightly shorter and thinner whereas for men, the handle 500 is thicker. This helps the handle efficiently be held by individuals with smaller hands. This protects the grip for an individual's hand while maintaining the same overall design from larger weights 502.

Figure 6:
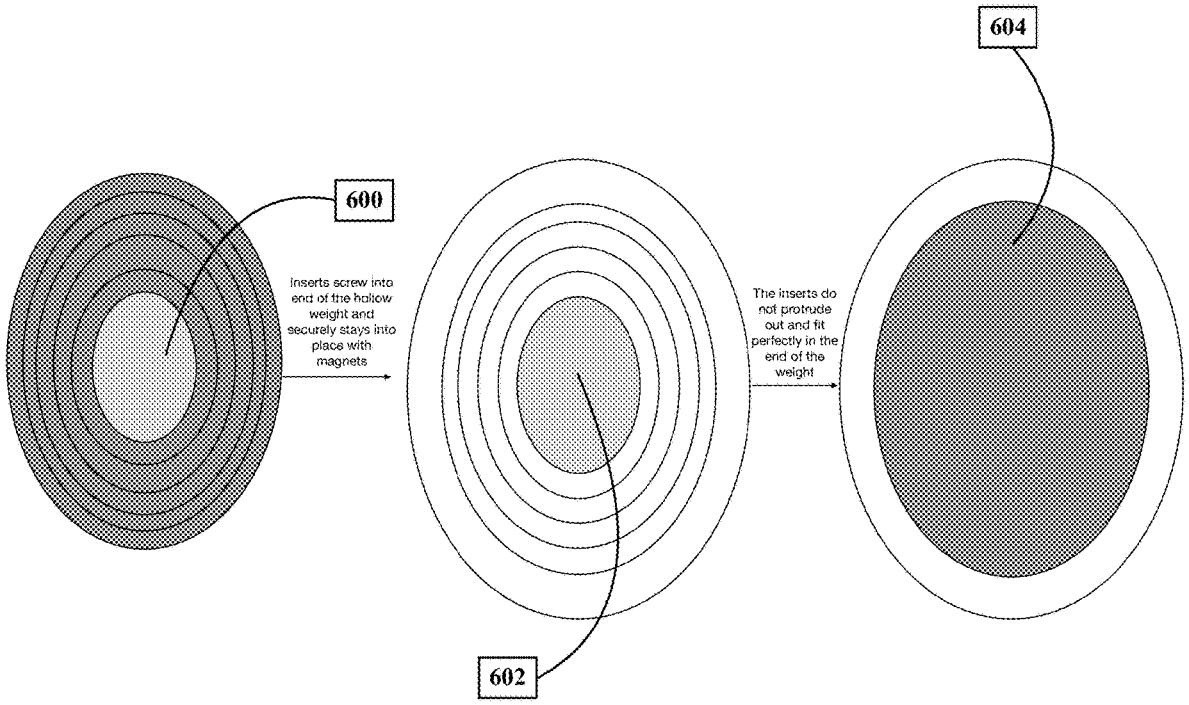
FIG. 6 is a diagram of how the inserts screw into place.

FIG. 6 is a diagram of how the inserts 600 screw into place. The inserts 600 and the inside of the end of the weight 602 both have magnets. The inserts screw into the end of the weight 604 and the magnets keep the inserts 600 securely in place. The inserts do not protrude out because the inside of the end of the weight 604 fits the insert perfectly inside. This helps maintain the security of the weight 604 for the hand grip.

Figure 7:
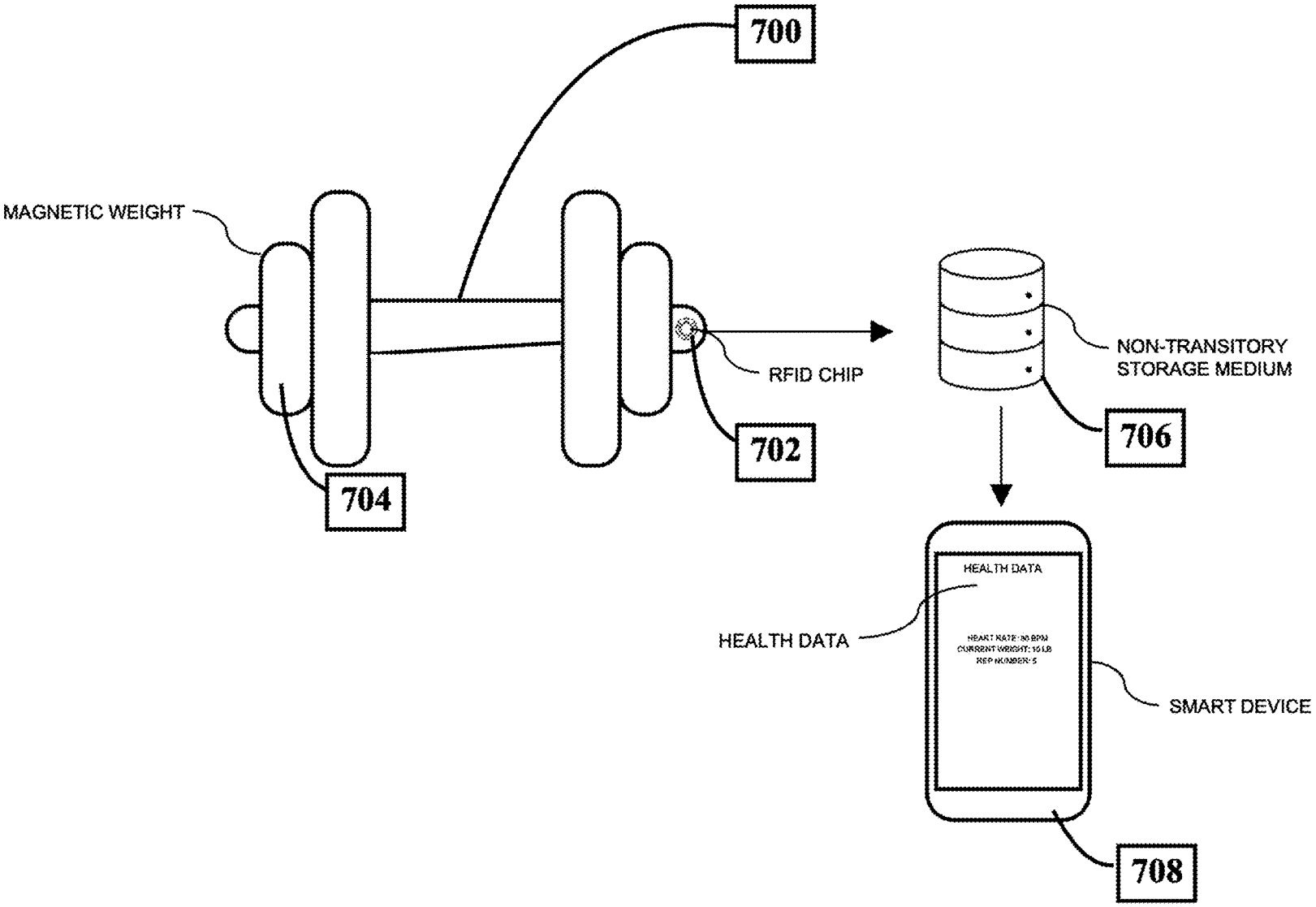
FIG. 7 is an overview of the RFID chip 702 technology within a dumbbell 700. The dumbbell 700 can provide health data, such as heart rate, and provide information regarding the weights currently used, in addition to the rep count. The dumbbell 700 further includes a magnetic weight 704. RFID chip 702 can also be used to track and monitor the location of the bar and weights. All data is transmitted to a storage medium comprising of both local and cloud memory 706 on a smart device 708. The sensors and RFID chip 702 technology within the weight instrument also provide various weightlifting datasets to a user's smart device 708.

FIG. 7 is an overview of the RFID chip 702 technology within a dumbbell 700. The dumbbell 700 can provide health data, such as heart rate, and provide information regarding the weights currently used, in addition to the rep count. The dumbbell 700 further includes a magnetic weight 704. RFID chip 702 can also be used to track and monitor the location of the bar and weights. All data is transmitted to a storage medium comprising of both local and cloud memory 706 on a smart device 708. The sensors and RFID chip 702 technology within the weight instrument also provide various weightlifting datasets to a user's smart device 708.

Figure 8:
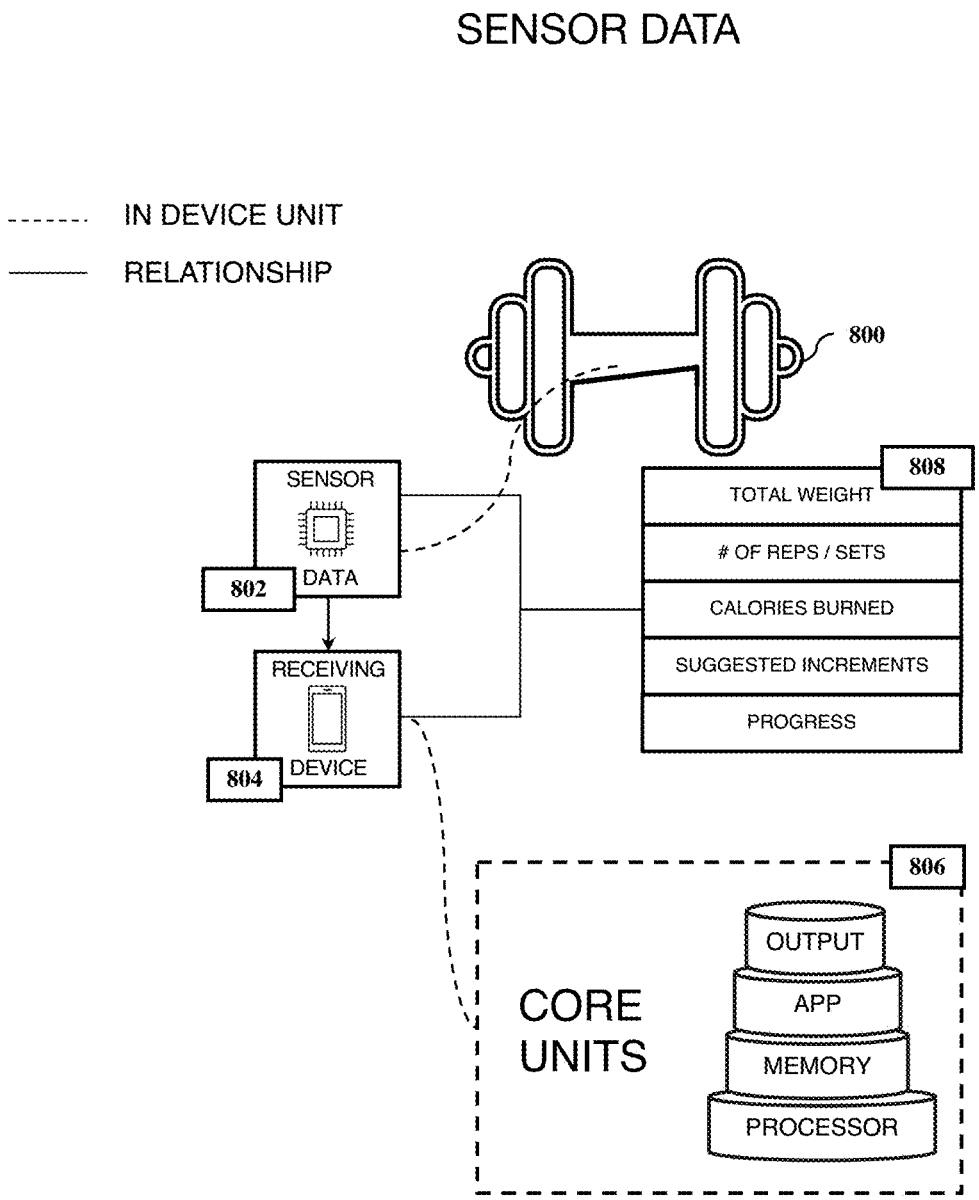
FIG. 8 is an overview of an embodiment wherein the weight instrument/ovular bar 800 has a sensor environment. Sensors 802 oriented on the ovular bar 800 and in some embodiments, the weights themselves. The sensors 802 transmit, to a receiving device 804 data 806 pertaining to weightlifting or any workout wherein the ovular bar 800 or incremental weight is utilized. Examples of data 808 units include total weight, number of sets and reps, calories burned, suggested increments, and progress.

FIG. 8 is an overview of an embodiment wherein the weight instrument/ovular bar 800 has a sensor environment. Sensors 802 oriented on the ovular bar 800 and in some embodiments, the weights themselves. The sensors 802 transmit, to a receiving device 804 data 806 pertaining to weightlifting or any workout wherein the ovular bar 800 or incremental weight is utilized. Examples of data 808 units include total weight, number of sets and reps, calories burned, suggested increments, and progress.

While various embodiments of the disclosed technology have been described above, it should be understood that they have been presented by way of example only, and not of limitation. Likewise, the various diagrams may depict an example architectural or other configuration for the disclosed technology, which is done to aid in understanding the features and functionality that may be included in the disclosed technology. The disclosed technology is not restricted to the illustrated example architectures or configurations, but the desired features may be implemented using a variety of alternative architectures and configurations. Indeed, it will be apparent to one of skill in the art how alternative functional, logical, or physical partitioning and configurations may be implemented to implement the desired features of the technology disclosed herein. Also, a multitude of different constituent module names other than those depicted herein may be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the disclosed technology is described above in terms of various exemplary embodiments and implementations, it should be understood that the various features, aspects and functionality described in one or more of the individual embodiments are not limited in their applicability to the particular embodiment with which they are described, but instead may be applied, alone or in various combinations, to one or more of the other embodiments of the disclosed technology, whether or not such embodiments are described and whether or not such features are presented as being a part of a described embodiment. Thus, the breadth and scope of the technology disclosed herein should not be limited by any of the above-described exemplary embodiments.

Terms and phrases used in this document, and variations thereof, unless otherwise expressly stated, should be construed as open-ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

What is claimed is:

1. An exercise weight with incremental inserts, comprising:

a plurality of attachable, incremental weight inserts, wherein said plurality of attachable, incremental weight inserts are chromatically categorized with respect to weight;

an angled, ovular bar with a first opposing hollow end and a second opposing hollow end, wherein said angled, ovular bar houses a plurality of sensors are configured to monitor and relay weightlifting data to a receiving device, and wherein said angled, ovular bar narrows at said second opposing hollow end to accommodate a natural positioning of a user's fingers;

a cavitied attachment fixture for said first opposing hollow end and said second opposing hollow end of said angled, ovular bar, capable of housing said plurality of attachable, incremental weight inserts; and a magnetic tightening mechanism supporting said plurality of attachable, incremental weight inserts on said cavitied attachment fixture on said first opposing hollow end and said second opposing hollow end of said angled, ovular bar.

2. The exercise weight of claim 1, wherein at least one of said plurality of sensors on said angled, ovular bar is a load sensor.

3. The exercise weight of claim 1, wherein said cavitied attachment fixture enables said plurality of attachable, incremental weight inserts to be screwed on and secured using said magnetic tightening mechanism with a threaded rod.

4. The exercise weight of claim 1, wherein a weight of said plurality of attachable, incremental weight inserts are distributed orbitally and enable a user to increase overall mass of said exercise weight by inserting at least one of said plurality of attachable, incremental weight inserts of a lower increment.

* * * * *